US010222114B2

(12) United States Patent
Tao et al.

(10) Patent No.: US 10,222,114 B2
(45) Date of Patent: Mar. 5, 2019

(54) SEMICONDUCTOR REFRIGERATOR

(71) Applicant: Qingdao Haier Joint Stock Co., Ltd., Qingdao (CN)

(72) Inventors: Haibo Tao, Qingdao (CN); Dong Yu, Qingdao (CN); Peng Li, Qingdao (CN); Jianru Liu, Qingdao (CN); Dingyuan Wang, Qingdao (CN); Chunyang Li, Qingdao (CN); Feifei Qi, Qingdao (CN); Lisheng Ji, Qingdao (CN)

(73) Assignee: QINGDAO HAIER JOINT STOCK CO., LTD, Qingdao (CN)

( * ) Notice: Subject to any disclaimer, the term of this patent is extended or adjusted under 35 U.S.C. 154(b) by 0 days.

(21) Appl. No.: 15/536,536

(22) PCT Filed: Sep. 28, 2015

(86) PCT No.: PCT/CN2015/090987
§ 371 (c)(1),
(2) Date: Jun. 15, 2017

(87) PCT Pub. No.: WO2016/095589
PCT Pub. Date: Jun. 23, 2016

(65) Prior Publication Data

US 2017/0350636 A1 Dec. 7, 2017

(30) Foreign Application Priority Data

Dec. 15, 2014 (CN) ..... 2014 1 0778449

(51) Int. Cl.
*F25D 16/00* (2006.01)
*F25B 21/02* (2006.01)
(Continued)

(52) U.S. Cl.
CPC ..... *F25D 16/00* (2013.01); *F25B 21/02* (2013.01); *F25D 11/00* (2013.01); *F25D 19/006* (2013.01);
(Continued)

(58) Field of Classification Search
CPC ..... F25B 21/02; F25B 2321/0251; F25B 2321/0252; F25D 11/00; F25D 16/00;
(Continued)

(56) References Cited

U.S. PATENT DOCUMENTS 3,181,310 A * 5/1965 Ammons ..... F25D 11/006 62/432
4,258,554 A * 3/1981 Asselman ..... F25B 25/005 165/275
(Continued)

FOREIGN PATENT DOCUMENTS

CN 2842324 11/2006
CN 202229500 5/2012
(Continued)

OTHER PUBLICATIONS

International Search Report and Written Opinion for corresponding International Application No. PCT/CN2015/090987, dated Dec. 30, 2015, 16 pages.

*Primary Examiner* — Travis C Ruby
(74) *Attorney, Agent, or Firm* — Alston & Bird LLP

(57) ABSTRACT

A semiconductor refrigerator, which comprises: a liner; at least one semiconductor cooler; and a plurality of cold end heat exchanging devices, each of which is configured to allow the refrigerant to flow therein and undergo phase-change heat exchange to transfer cold from the cold end of the semiconductor cooler to the storage compartment of the liner. Each of the cold end heat exchanging devices has three refrigerant pipelines, each refrigerant pipeline having an evaporation section which is downwardly bent and extends in a vertical plane and has a closed tail end, the evaporation
(Continued)

sections of the three refrigerant pipelines of each of the cold end heat exchanging devices being thermally connected to the rear wall and two side walls of the liner respectively.

11 Claims, 4 Drawing Sheets

(51) Int. Cl.
*F25D 19/00* (2006.01)
*F25D 11/00* (2006.01)
*F25D 23/06* (2006.01)
*F28D 15/02* (2006.01)

(52) U.S. Cl.
CPC ..... *F25D 23/066* (2013.01); *F28D 15/0233* (2013.01); *F28D 15/0275* (2013.01); *F25B 2321/0251* (2013.01); *F25B 2321/0252* (2013.01); *F28D 2015/0216* (2013.01)

(58) Field of Classification Search
CPC ..... F25D 17/02; F25D 23/066; F25D 23/068; F28D 15/0266; F28D 15/04; F28D 15/020275; F28D 2015/0216
See application file for complete search history.

(56) References Cited

U.S. PATENT DOCUMENTS 5,653,111 A * 8/1997 Attey ..... F04D 13/0673 165/170
6,658,857 B1 * 12/2003 George ..... F25B 21/04 165/121
6,776,220 B1 * 8/2004 Low ..... B64G 1/506 165/104.33
2001/0023762 A1 * 9/2001 Sagal ..... F28D 15/0233 165/185
2001/0039802 A1 * 11/2001 Barrash ..... F25B 9/14 62/6
2003/0029174 A1 * 2/2003 Lee ..... F24F 5/0042 62/3.6
2010/0154452 A1 * 6/2010 McCann ..... A23B 4/066 62/247
2012/0047917 A1 * 3/2012 Rafalovich ..... F25D 11/025 62/66
2013/0291559 A1 * 11/2013 June ..... F25B 21/00 62/3.2
2013/0291563 A1 * 11/2013 Edwards ..... F25B 21/02 62/3.3
2015/0075184 A1 * 3/2015 Edwards ..... F25B 21/02 62/3.2

FOREIGN PATENT DOCUMENTS

CN 103199316 A 7/2013
CN 203810826 9/2014
CN 104567175 A 4/2015
JP H06159894 A 6/1994

* cited by examiner

SEMICONDUCTOR REFRIGERATOR

CROSS-REFERENCE TO RELATED APPLICATIONS

This application is a national phase entry of International Application No. PCT/CN2015/090987, filed Sep. 28, 2015, which claims priority to Chinese Application No. 201410778449.0, filed Dec. 15, 2014, the entire contents of which are incorporated herein by reference.

TECHNICAL FIELD

The present invention relates to a refrigeration apparatus and, more particularly, to a semiconductor refrigerator.

BACKGROUND OF THE INVENTION

A semiconductor refrigerator is also known as a thermoelectric refrigerator. A semiconductor refrigerator uses a semiconductor cooler to achieve refrigeration by means of heat dissipation and conduction technologies through efficient annular double-layer heat pipes and automatic variable pressure and flow control technology, without the need of any refrigeration medium and mechanical moving components, and solves the problems in applications of traditional mechanical refrigerators, such as pollution from media and mechanical vibration.

However, the semiconductor refrigerator has to effectively transfer the temperature at the cold end of the semiconductor cooler into the storage compartment of the refrigerator. The prior art generally uses a heat radiator for forced convection, which is in direct contact with the cold end of the semiconductor cooler and exchanges heat with the storage compartment. The heat conduction and exchange efficiency between solid bodies is low, and is not conducive to the optimal performance of the semiconductor. The heat dissipation fins are bulky and take up much space in the refrigerator, and when combined with a fan, the noise is increased. In addition, the continuous operation of the fan reduces its reliability.

SUMMARY OF THE INVENTION

An object of the present invention is to overcome at least one defect of the existing semiconductor refrigerators and to provide a semiconductor refrigerator with high heat exchange efficiency.

A further object of the present invention is to minimize the noise generated by the semiconductor refrigerator and to improve the reliability thereof.

In order to achieve at least one of the above objects, the present invention provides a semiconductor refrigerator. The semiconductor refrigerator comprises:

a liner having a storage compartment defined therein;

at least one semiconductor cooler disposed behind a rear wall of the liner; and a plurality of cold end heat exchanging devices, each of the cold end heat exchanging devices being configured to allow the refrigerant to flow therein and undergo phase-change heat exchange to transfer cold from the cold end of the at least one semiconductor cooler to the storage compartment of the liner; and each of the cold end heat exchanging devices has three refrigerant pipelines, each refrigerant pipeline having an evaporation section which is downwardly bent and extends in a vertical plane and has a closed tail end, the evaporation sections of the three refrigerant pipelines of each of the cold end heat exchanging devices being thermally connected to the rear wall and two side walls of the liner respectively.

Optionally, each of the cold end heat exchanging devices further has a cold end heat exchanging part defining an inner cavity or pipeline for containing a refrigerant existing in both gas and liquid phases; and each of the refrigerant pipelines further comprises a connection section which is upwardly bent and extends from a starting end of the evaporation section thereof and is connected to an inner cavity or pipeline of the respective cold end heat exchanging part.

Optionally, the cold end heat exchanging part of each of the cold end heat exchanging devices has a flat rectangular cuboid shape with the area of a front surface and a rear surface opposite each other being larger than the area of other surfaces, and the rear surface of each of the cold end heat exchanging part is arranged parallel to the rear wall of the liner and serves as a heat exchange surface which is thermally connected to a cold source.

Optionally, the number of the at least one semiconductor cooler is more than one, and the cold ends of the semiconductor coolers are thermally connected to the rear surface of the cold end heat exchanging part of a corresponding one of the cold end heat exchanging devices respectively.

Optionally, the cold end heat exchanging parts of the plurality of the cold end heat exchanging devices are arranged at intervals in the vertical direction.

Optionally, the number of the plurality of cold end heat exchanging devices is two; and the evaporation sections of two of the refrigerant pipelines of one of the two cold end heat exchanging devices are thermally connected to front half portions of outer surfaces of the two side wall of the liner respectively; and the evaporation sections of two of the refrigerant pipelines of the other cold end heat exchanging device are thermally connected to rear half portions of the outer surfaces of the two side wall of the liner respectively.

Optionally, the number of the plurality of cold end heat exchanging devices is two; and the evaporation section of one of the refrigerant pipelines of one of the two cold end heat exchanging devices is thermally connected to a left half portion of an outer surface of the rear wall of the liner; and the evaporation section of one of the refrigerant pipelines of the other cold end heat exchanging device is thermally connected to a right half portion of the outer surface of the rear wall of the liner.

Optionally, the thermal connection between the evaporation sections of the three refrigerant pipelines of each of the cold end heat exchanging devices and the respective rear wall and two side walls of the liner is implemented by abutting the evaporation sections of the three refrigerant pipelines of each of the cold end heat exchanging devices respectively against outer surfaces of the rear wall and the two side walls of the liner.

Optionally, the evaporation section of each of the refrigerant pipelines has a projected length on a horizontal plane that is smaller than ½ of the width of the respective rear wall or side walls of the liner and greater than ¼ of the width of the respective rear wall or side walls of the liner.

Optionally, the evaporation section of each of the refrigerant pipelines comprises: a plurality of straight pipe segments disposed at intervals in the vertical direction, each of the straight pipe segments being arranged obliquely at an angle of 10° to 70° with respect to the horizontal plane; bent segments, each connecting two adjacent straight pipe segments.

Optionally, the semiconductor refrigerator further comprises: a plurality of retention steel wires disposed in the vertical direction; and a pipe wall at an outer vertex of each of the bent segments on the same side of each of the refrigerant pipelines is welded to one of the retention steel wires.

Optionally, the lower end of each of the refrigerant pipelines is located at the same horizontal level.

Since the semiconductor refrigerator of the present invention has a plurality of cold end heat exchanging devices, the effective heat exchange area thermally connected to the liner of the refrigerator is significantly increased, thereby significantly improving the energy efficiency of the semiconductor refrigerator. Semiconductor coolers may be used for refrigeration at the same time, further improving the energy efficiency of the semiconductor refrigerator.

Further, the three refrigerant tubes of each of the cold end heat exchanging devices in the semiconductor refrigerator of the present invention are thermally connected to the rear wall and the two side walls of the liner respectively so that the heat exchange efficiency of each of the cold end heat exchanging devices is substantially equal to better protect the semiconductor refrigerator.

Further, in the semiconductor refrigerator of the present invention, one end of each of the refrigerant pipelines is connected to the respective cold end heat exchanging part and is obliquely downwardly bent and extends, the use of phase-change circulation heat exchange of the refrigerant in the cold end heat exchanging part and the plurality of refrigerant pipelines effectively conducts the temperature of the cold end of the semiconductor cooler, and the use of the plurality of separate refrigerant pipelines makes the processing technology more convenient and facilitate the fitting with the refrigerator structure. Meanwhile, a cold dissipation fan is omitted, thereby reducing the noise of the semiconductor refrigerator, and improving the reliability of the semiconductor refrigerator.

Further, in the semiconductor refrigerator of the present invention, the outer surface of the rear wall of the cold end heat exchanging part is thermally connected to the cold end of the semiconductor cooler in abutting contact or other manners, and at least a portion of each of the refrigerant pipelines of the cold end heat exchanging part is abutted against the outer surface of the liner, so that the liner is used for heat conduction, thereby making full use of the refrigerator structure and taking up small space.

The foregoing and other objects, advantages and features of the present invention will become more apparent to those skilled in the art from the following detailed description of specific embodiments of the invention taken in conjunction with the accompanying drawings.

BRIEF DESCRIPTION OF THE DRAWINGS

Some specific embodiments of the present invention will be described in detail by way of example only rather than by way of limitation with reference to the accompanying drawings. The same reference numerals in the accompanying drawings denote the same or similar components or parts. It should be understood by those skilled in the art that these drawings are not necessarily to scale. In the accompanying drawings.

DETAILED DESCRIPTION OF THE INVENTION

Figure 1:
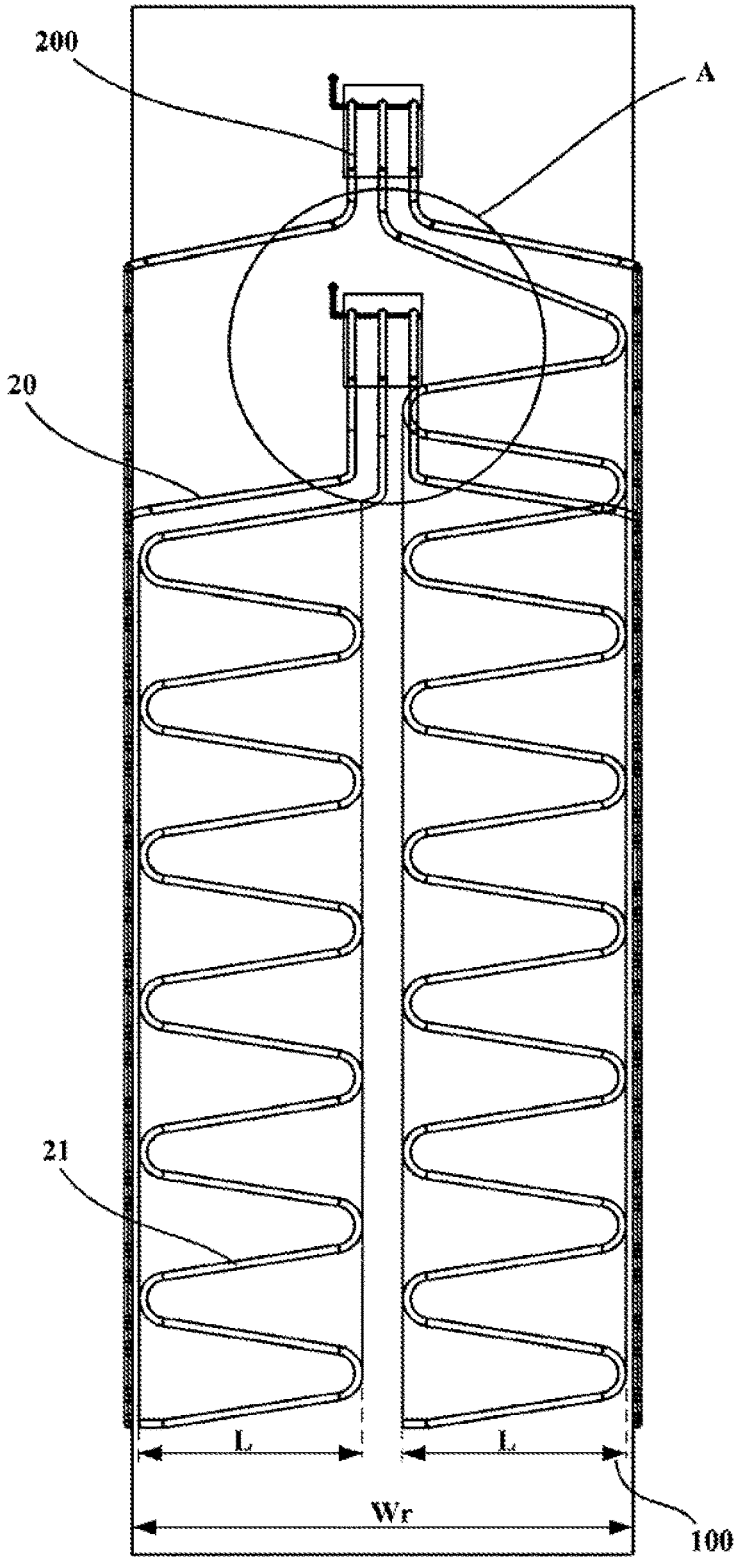
FIG. 1 is a schematic rear view of a partial structure of a semiconductor refrigerator according to one embodiment of the present invention.

The embodiments of the present invention will be described below in detail, and the examples of embodiments are shown in the drawings. The embodiments described below with reference to the drawings are exemplary and are merely used to explain the present invention, and cannot be interpreted as a restriction on the present invention. In the description of the present invention, the azimuth or positional relationship indicated by the terms "upper", "lower", "front", "rear" and the like is based on the azimuth or positional relationship shown in the drawings only for the purpose of facilitating the description of the invention, rather than requiring that the present invention must be constructed and operated in the particular azimuth, and therefore cannot be construed as limiting the present invention.

Figure 2:
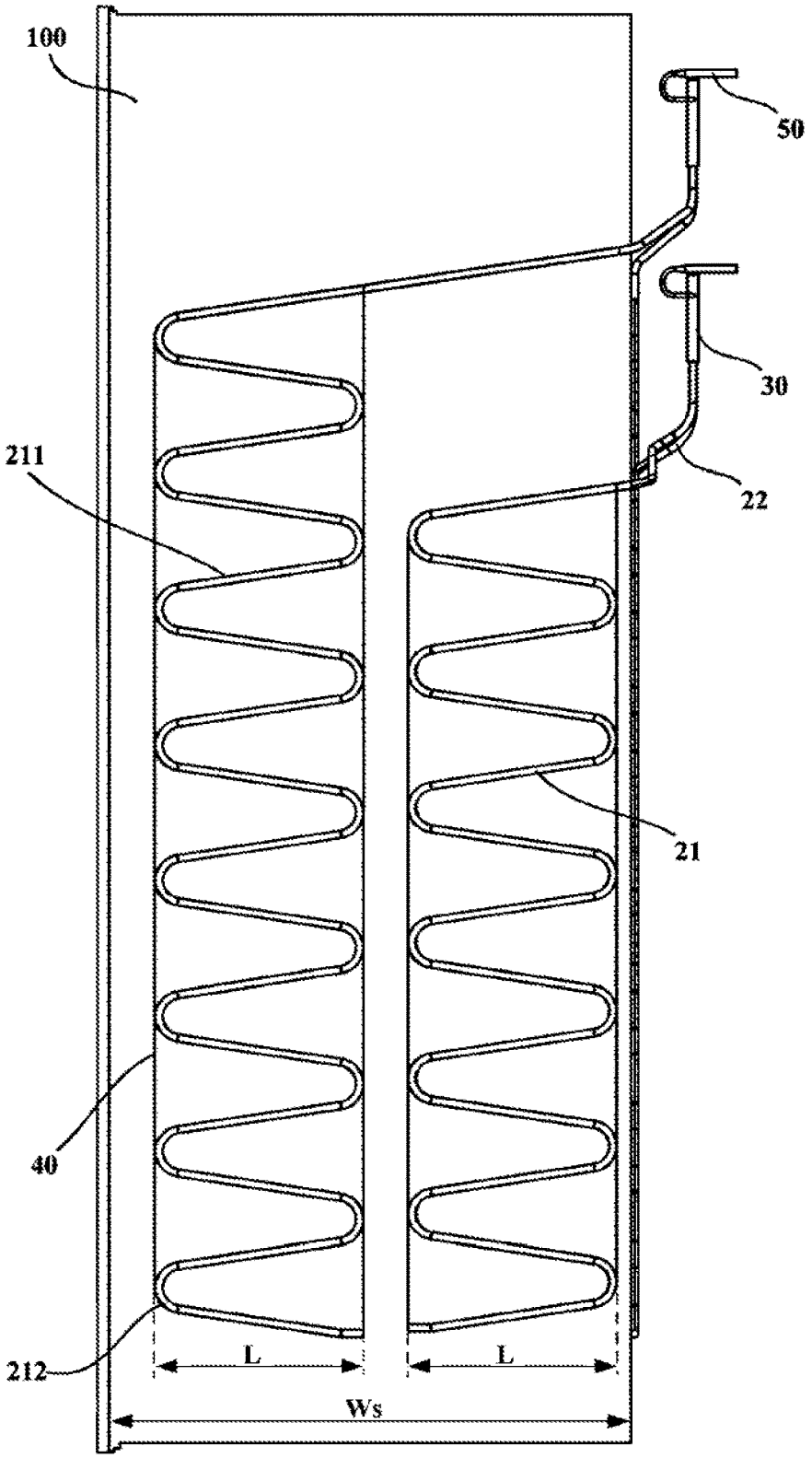
FIG. 2 is a schematic right view of a partial structure of a semiconductor refrigerator according to one embodiment of the present invention.
Figure 3:
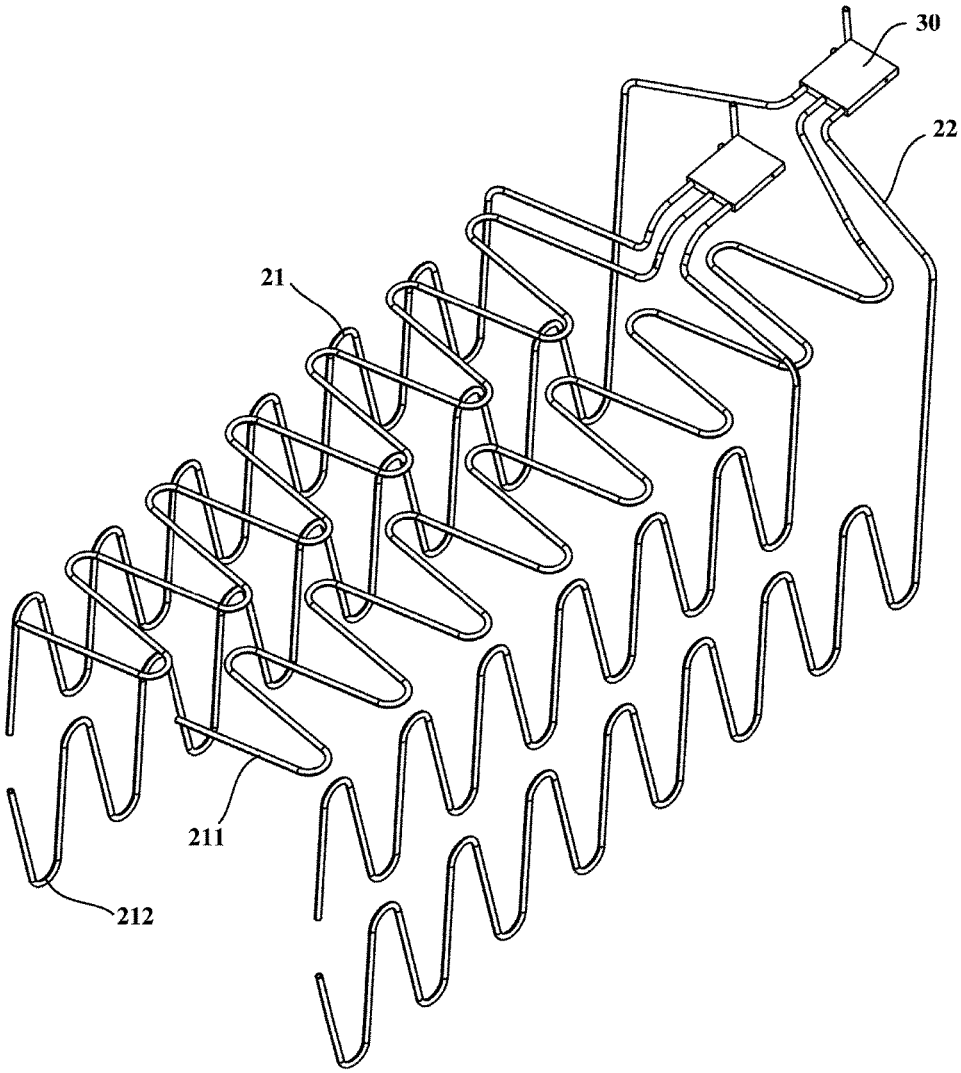
FIG. 3 is a schematic structural view of a partial structure of a semiconductor refrigerator according to one embodiment of the present invention.

FIG. 1 is a schematic rear view of a partial structure of a semiconductor refrigerator according to one embodiment of the present invention, in which a liner 100 and a plurality of cold end heat exchanging devices 200 of the semiconductor refrigerator are shown. As shown in FIG. 1, and with reference to FIGS. 2 and 3, the embodiments of the present invention provide a semiconductor refrigerator. The semiconductor refrigerator may generally comprise: a liner 100, a semiconductor cooler, a cold end heat exchanging device 200, a hot end heat exchanger 600, a housing, a door and an insulation layer. The liner 100 has a storage compartment defined therein. In particular, in the semiconductor refrigerator of the present invention, the number of the semiconductor coolers is at least one, and the number of the cold end heat exchanging devices 200 is more than one. Each of the cold end heat exchanging devices 200 is configured to allow the refrigerant to flow therein and undergo phase-change heat exchange to transfer cold from the cold end of the at least one semiconductor cooler to the storage compartment of the liner 100. Each of the cold end heat exchanging devices 200 has three refrigerant pipelines 20, and each of the three refrigerant pipelines 20 has an evaporation section 21 which is downwardly bent and extends in a vertical plane and has a closed tail end. The evaporation sections 21 of the three refrigerant pipelines 20 of each of the cold end heat exchanging devices 200 are thermally connected to the rear wall and two side walls of the liner 100 respectively, to improve the refrigeration efficiency of the semiconductor refrigerator.

In the embodiment of the present invention, the number of the semiconductor coolers may be one, provided at the rear of the rear wall of the liner 100, and the cold end thereof is thermally connected to the plurality of cold end heat exchanging devices 200 by means of heat conducting devices, respectively; and the number of the semiconductor coolers may be more than one, which are all provided at the rear of the rear wall of the liner 100, and the cold ends of the semiconductor coolers are thermally connected to a corresponding one of the cold end heat exchanging devices 200 respectively to further improve the energy efficiency ratio of the semiconductor refrigerator.

In some embodiments of the present invention, each of the cold end heat exchanging devices 200 further has a cold end heat exchanging part 30 defining an inner cavity or pipeline for containing a refrigerant existing in both gas and liquid phases. Each of the refrigerant pipelines 20 further comprises a connection section 22 which is upwardly bent and extends from a starting end of the evaporation section 21 thereof and is connected to an inner cavity or pipeline of the respective cold end heat exchanging part 30. The refrigerant poured into the cold end heat exchanging part 30 and the refrigerant pipelines 20 may be carbon dioxide or other refrigeration medium, and the pouring amount of the refrigerant may be measured by a test. The downwardly and extending structure of each of the refrigerant pipelines 20 should ensure that the liquid refrigerant can be free to flow in the pipeline by gravity. When the cold end heat exchanging device 200 of the present embodiment works, the refrigerant is subjected to a gas-liquid phase change in the cold end heat exchanging part 30 and the refrigerant pipeline 20 for thermal cycling.

The cold end heat exchanging part 30 of each of the cold end heat exchanging devices 200 may have a flat rectangular cuboid shape, and may be disposed between the rear wall of the liner 100 and the rear wall of the housing. For example, a distance may be provided between the front surface of the cold end heat exchanging part 30 and the rear wall of the liner 100 to ensure that the heat is not conducted to the liner 100 during a power failure or an operational failure, causing an abnormal temperature.

The area of a front surface and a rear surface, disposed opposite to each other, of each of the cold end heat exchanging parts 30 is larger than the area of the other surfaces, and the rear surface of the cold end heat exchanging part 30 is arranged parallel to the rear wall of the liner 100 and is used as a heat transfer surface which is thermally connected to a cold source (e.g., the cold end of a semiconductor cooler), the thermal connection may be such that the outer surface is in direct contact with and abutted against the cold source or in contact with same via a thermally conductive layer, wherein the thermally conductive layer may be thermally conductive silica gel or graphite or the like coated between the outer surface and the cold source. The "thermal connection" or "thermal contact" in the present embodiment may be direct abutting and contact, and the heat transfer is carried out by means of heat conduction. If the abutted contact surface is coated with thermally conductive silicone grease (graphite or other medium), it may be considered to be part of the abutted contact surface as a thermally conductive layer for improving the thermal connection (or thermal contact).

In the embodiment of the present invention, the number of the semiconductor coolers is more than one, so that cold ends are thermally connected to the rear surface of the cold end heat exchanging part 30 of a cold end heat exchanging device 200 respectively, for example, semiconductor coolers may be selectively arranged in an installation space defined by the outer side of the outer wall of the liner 100 and the rear wall of the housing, and the cold ends thereof may be respectively abutted against the rear surface of the cold end heat exchanging part 30 of a cold end heat exchanging device 200.

The working process of the semiconductor refrigerator of the embodiment of the present invention is as follows: when the semiconductor cooler is powered on and operates, the temperature of the cold end decreases, the temperature of the cold end heat exchanging part 30 correspondingly decreases due to the conduction, and the gaseous refrigerant therein undergoes phase change to be condensed when subjected to cold, to change into the liquid refrigerant at a low temperature; and the liquid refrigerant flows down due to gravity along the cavity of the refrigerant pipeline 20, and the condensed flown-down refrigerant is heated, undergoes phase change and is evaporated in the refrigerant pipeline 20 since it absorbs heat from the interior of the refrigerator to change into a gaseous state. The gaseous vapour will rise under the driving of the pressure of a heat source, and the gaseous refrigerant will rise to the cold end heat exchanging part 30 to continue to condense, thereby repeating the refrigeration, resulting in the lowered temperature of the storage compartment so that the cooling is achieved.

In some embodiments of the present invention, the number of the plurality of cold end heat exchanging devices 200 is two. The evaporation sections 21 of two of the refrigerant pipelines 20 of one cold end heat exchanging device 200 of the two cold end heat exchanging devices 200 are thermally connected to front half portions of the outer surfaces of the two side walls of the liner 100 respectively; and the evaporation sections 21 of two of the refrigerant pipelines 20 of the other cold end heat exchanging device 200 are thermally connected to rear half portions of the outer surfaces of the two side wall of the liner 100 respectively. The evaporation section 21 of one of the refrigerant pipelines 20 of one cold end heat exchanging device 200 of the two cold end heat exchanging devices 200 is thermally connected to a left half portion of the outer surface of the rear wall of the liner 100; and the evaporation section 21 of one of the refrigerant pipelines 20 of the other cold end heat exchanging device 200 is thermally connected to a right half portion of the outer surface of the rear wall of the liner 100.

In order to better transfer the cold of each evaporation section 21 to the liner 100 of the refrigerator, the thermal connection between the evaporation sections 21 of the three refrigerant pipelines 20 of each of the cold end heat exchanging device 200 and the respective rear wall and the two side walls of the liner 100 is achieved by abutting the evaporation sections 21 of the three refrigerant pipelines of each of the cold end heat exchanging device 200 against the outer surfaces of the rear wall and the two side walls of the liner 100, respectively. In some alternative embodiments of the present invention, each evaporation section 21 may be abutted against a respective flat thermally conductive plate, and the flat thermally conductive plates are abutted against the rear wall and the two side walls of the liner 100, so that the liner 100 of the refrigerator is cooled more evenly.

In order to maximize the effective heat exchange area, the evaporation section 21 of each of the refrigerant pipelines 20 has a projected length L on a horizontal plane that is smaller than ½ of the width (Wr, Ws) of the respective rear wall or side walls of the liner 100 and greater than ¼ of the width of the respective rear wall or side walls of the liner 100.

Figure 4:
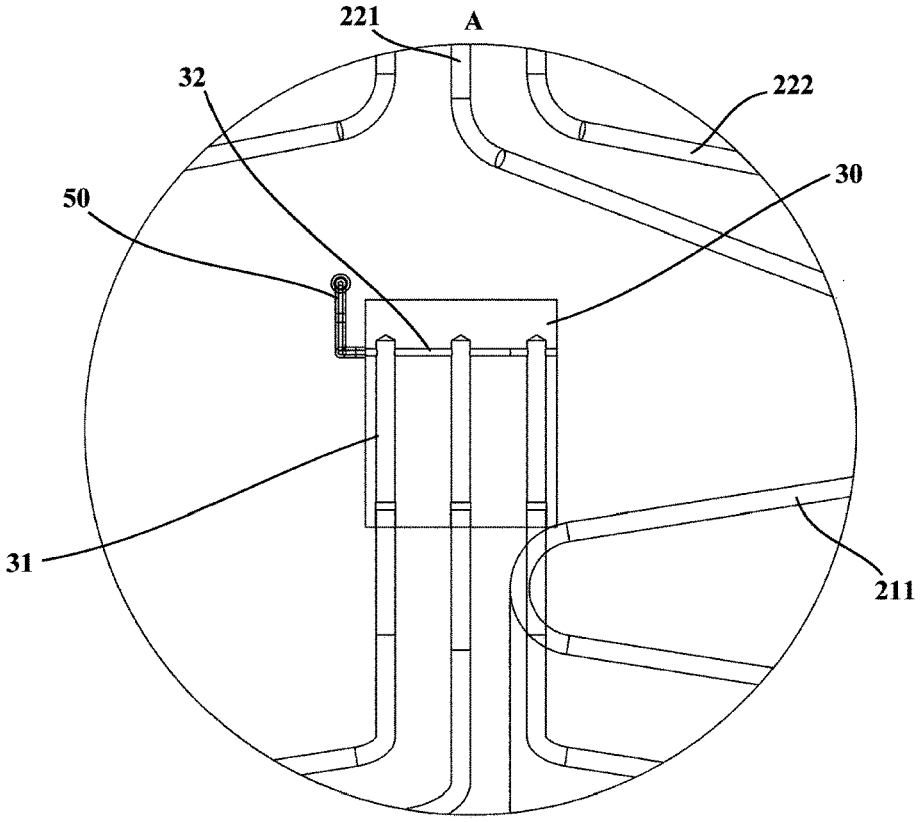
FIG. 4 is a schematic partial enlarged view of A in FIG. 1.

In some embodiments of the present invention, each of the refrigerant pipelines 20 may be selected from a copper tube, a stainless steel tube, an aluminum tube, etc., preferably a copper tube. As shown in FIG. 4, the connection section 22 of the refrigerant pipeline 20 of each cold end heat exchanging device 200 of which the evaporation section 21 is thermally connected to the side wall of the liner 100 may comprise a first segment 221 and a second segment 222, wherein the first segment 221 is in communication with the inner cavity or pipeline of the cold end heat exchanging part 30 and extends to the outside of the cold end heat exchanging part 30; and the second segment 222 is connected to the first segment 221, extends transversely and obliquely downwardly on the rear wall of the liner 100, and then is obliquely downwardly bent forwards to the side wall of the liner 100 to connect the evaporation section 21 of the corresponding refrigerant pipeline 20. The connection section 22 of the refrigerant pipeline 20 of each cold end heat exchanging device 200 of which the evaporation section 21 is thermally connected to the rear wall of the liner 100 may include only the first segment 221.

The evaporation section 21 of each refrigerant pipeline 20 may include a plurality of vertically spaced straight pipe segments 211 and bent segments 212, each bent segment being used for connecting two adjacent straight pipe segments 211, wherein each of the straight pipe segments 211 is arranged obliquely at an angle of 10° to 70° with respect to the horizontal plane, to ensure that the liquid refrigerant is free to flow therein by gravity, and the bent segment 212 is preferably arranged in a "C" shape or is an arc-shaped section so that the evaporator section 21 is generally of an inclined "Z"-shaped structure.

The semiconductor refrigerator of the embodiments of the present invention further comprises a plurality of retention steel wires 40 in order to prevent elastic deformation of the evaporation section 21 of each of the refrigerant pipelines 20. Each of the retention steel wires 40 is disposed in the vertical direction. A pipe wall at an outer vertex (also referred to as a top hump) of each of the bent segments 212 on the same side of each of the refrigerant pipelines 20 is welded to a corresponding retention steel wire 40. Specifically, the two retention steel wires 40 may be respectively fixed to two sides of the evaporation section 21 of a corresponding refrigerant pipeline 20, and each of the retention steel wires 40, at different locations along its length, is successively fixed to the top hump of each of the bent segments on the corresponding side of the corresponding evaporation section. Further, other portions of each of the refrigerant pipelines 20 that are in contact with the respective retention steel wire 40 may be all welded to the retention steel wire 40.

In the embodiment of the present invention, the cold end heat exchanging part 30 of each of the cold end heat exchanging devices 200 may be a heat exchange copper block in which three stepped blind holes 31 extending in the vertical direction and a horizontal tube hole 32 communicating with the upper portion of each of the step blind holes 31 are provided to form a pipeline inside the cold end heat exchanging part 30. The upper end of each of the refrigerant pipelines 20 can be inserted into the corresponding stepped blind hole 31. The cold end heat exchanging device 200 further comprises a refrigerant pouring tube 50 having one end being in communication with the corresponding horizontal tube bore 32 and the other end being operatively open the normally closed end to receive the refrigerant poured from the outside, so as to pour the refrigerant into each of the refrigerant pipelines 20.

In some alternative embodiments of the present invention, the cold end heat exchanging part 30 of the cold end heat exchanging device 200 may be a cold end heat exchange box which defines an inner cavity or pipeline for containing a refrigerant existing in both gas and liquid phases and is configured to allow the refrigerant to undergo phase-change heat exchange. The connection section 22 of each of the refrigerant pipelines 20 is in communication with the lower portion of the inner cavity. The cold end heat exchanging device 200 may be further provided with a three-way device for pouring the refrigerant. The three-way device is located on the connection section 22 of one refrigerant pipeline 20 with the first and second ends thereof being used to communicate the corresponding two segments of the connection section 22 and the third end being configured to operatively open the normally closed end to receive the refrigerant poured from the outside. The use of the three-way device reduces the difficulty of the process of pouring the refrigerant and provides a means for maintaining.

In some alternative embodiments of the present invention, the cold end heat exchanging part 30 of each of the cold end heat exchanging devices 200 may be a heat exchange copper block. Two ends of each of the refrigerant pipelines 20 are both closed and the interior thereof is poured with a refrigerant, and the upper end of each of the refrigerant pipelines 20 is inserted into the corresponding heat exchange copper block. Each of the refrigerant pipelines 20 may be provided with a valve for pouring the refrigerant.

In some embodiments of the present invention, the cold end heat exchanging parts 30 of the plurality of cold end heat exchanging devices 200 are disposed at intervals in the vertical direction, and the lower end of each of the refrigerant pipelines 20 may be at the same horizontal level.

Figure 5:
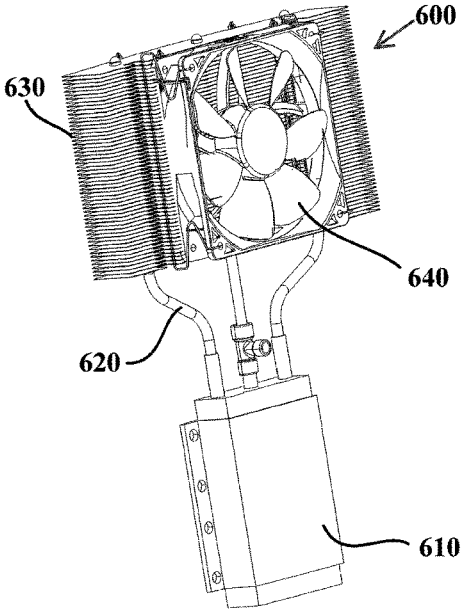
FIG. 5 is a schematic structural view of a hot end heat exchanging device of a semiconductor refrigerator according to one embodiment of the present invention.

In order to solve the heat dissipation problem of the hot end of the semiconductor cooler, the semiconductor refrigerator of this embodiment may further comprise a plurality of hot end heat exchanging devices 600, which are thermally connected to a plurality of hot end of the semiconductor coolers respectively for diffusing the heat generated by the hot end to the surrounding environment. For example, as shown in FIG. 5, the hot end heat exchanging device 600 comprises a hot end heat exchanging box 610, a plurality of heat dissipation pipelines 620, heat dissipation fins 630, and a fan 640. The hot end heat exchanging box 610 defines an inner cavity for containing a refrigerant existing in both gas and liquid phases and configured to allow the refrigerant to undergo phase-change heat exchange. The plurality of heat dissipation pipelines 620 are configured to allow the refrigerant to flow therein and undergo phase-change heat exchange, and the first end of each heat dissipation pipeline that forms the opening end is connected to the upper portion of the inner cavity of the hot end heat exchanging box 610, and each heat dissipation pipeline is obliquely upwardly bent and extends from the first end thereof and terminates at the second end forming the closed end. The heat dissipation fins 630 are disposed on the plurality of heat dissipation pipelines 620. The fan 640 is fixed to the heat dissipation fins 630 via a fastening mechanism to perform forced convection heat dissipation on the heat transferred from the plurality of heat dissipation pipelines 620 to the heat dissipation fins 630. In some alternative embodiments of the present invention, other forms of the hot end heat exchanging device may also be used by those skilled in the art, for example, using a hot end heat exchanging device comprising a heat pipe, a fin and a fan. A person skilled in the art may also use the device which is obtained by inverting the cold end heat exchanging device of any of the aforementioned embodiments of the present invention (such that the cold end heat exchanging part is located below the evaporation section thereof) as a hot end heat exchanging device, during mounting, the cold end heat exchanging part of the cold end heat exchanging device ma be thermally connected to the hot end of the semiconductor cooler, and the evaporation section thereof is abutted against the inner surface of the housing to achieve the heat dissipation of the semiconductor refrigerator.

At this point, those skilled in the art will recognize that, while numerous exemplary embodiments of the present invention have been shown and described in detail herein, many other variations or modifications that conform to the principles of the present invention may be determined or derived directly from the disclosure of the present invention without departing from the spirit and scope of the present invention. It therefore should be understood and determined that the scope of the present invention covers all such other modifications or modifications.

What is claimed is:

1. A semiconductor refrigerator, comprising:

a liner having a storage compartment defined in the liner;

at least one semiconductor cooler disposed behind a rear wall of the liner; and a plurality of cold end heat exchanging devices, each of the cold end heat exchanging devices being configured to allow the refrigerant to flow in the cold end heat exchanging device and undergo phase-change heat exchange to transfer cold from the cold end of the at least one semiconductor cooler to the storage compartment of the liner; and each of the cold end heat exchanging devices has three refrigerant pipelines, each refrigerant pipeline having an evaporation section which is bent to point in a first direction and extends in a vertical plane and has a closed tail end, and the evaporation sections of the three refrigerant pipelines of each of the cold end heat exchanging devices being thermally connected in one-to-one correspondence to the rear wall and two side walls of the liner respectively, wherein the evaporation section of each of the refrigerant pipelines comprises:

a plurality of straight pipe segments disposed at intervals in the vertical direction, each of the straight pipe segments being arranged obliquely at an angle of 10° to 70° with respect to the horizontal plane; and bent segments, each connecting two adjacent straight pipe segments, wherein the bent segments are arc-shaped sections.

2. The semiconductor refrigerator according to claim 1, characterized in that each of the cold end heat exchanging devices further has a cold end heat exchanging part defining an inner cavity or pipeline for containing a refrigerant existing in both gas and liquid phases; and each of the refrigerant pipelines further comprises a connection section which is bent to point in a second direction opposite to the first direction and extends from a starting end of the evaporation section thereof and is connected to an inner cavity or pipeline of the respective cold end heat exchanging part.

3. The semiconductor refrigerator according to claim 2, characterized in that the cold end heat exchanging part of each of the cold end heat exchanging devices has a rectangular cuboid shape with the areas of a front surface and a rear surface opposite each other being larger than the areas of four side-surfaces between the front surface and the rear surface, and the rear surface of each of the cold end heat exchanging part is arranged parallel to the rear wall of the liner and serves as a heat exchange surface which is thermally connected to a cold source.

4. The semiconductor refrigerator according to claim 3, characterized in that the number of the at least one semiconductor cooler is more than one, and the cold ends of the semiconductor coolers are thermally connected to the rear surface of the cold end heat exchanging part of a corresponding one of the cold end heat exchanging devices respectively.

5. The semiconductor refrigerator according to claim 4, characterized in that the cold end heat exchanging parts of the plurality of the cold end heat exchanging devices are arranged at intervals in the vertical direction.

6. The semiconductor refrigerator according to claim 1, characterized in that the number of the plurality of cold end heat exchanging devices is two; and the evaporation sections of two of the refrigerant pipelines of one of the two cold end heat exchanging devices are thermally connected to front half portions of outer surfaces of the two side walls of the liner respectively; and the evaporation sections of two of the refrigerant pipelines of the other cold end heat exchanging device are thermally connected to rear half portions of the outer surfaces of the two side wall of the liner respectively.

7. The semiconductor refrigerator according to claim 1, characterized in that the number of the plurality of cold end heat exchanging devices is two; and the evaporation section of one of the refrigerant pipelines of one of the two cold end heat exchanging devices is thermally connected to a left half portion of an outer surface of the rear wall of the liner; and the evaporation section of one of the refrigerant pipelines of the other cold end heat exchanging device is thermally connected to a right half portion of the outer surface of the rear wall of the liner.

8. The semiconductor refrigerator according to claim 1, characterized in that the thermal connection between the evaporation sections of the three refrigerant pipelines of each of the cold end heat exchanging devices and the respective rear wall and two side walls of the liner is implemented by abutting the evaporation sections of the three refrigerant pipelines of each of the cold end heat exchanging devices respectively against outer surfaces of the rear wall and the two side walls of the liner.

9. The semiconductor refrigerator according to claim 1, characterized in that the evaporation section of each of the refrigerant pipelines has a projected length on a horizontal plane that is smaller than ½ of the width of the respective rear wall or side walls of the liner and greater than ¼ of the width of the respective rear wall or side walls of the liner.

10. The semiconductor refrigerator according to claim 1, characterized by further comprising:

a plurality of retention steel wires disposed in the vertical direction; and a pipe wall at an outer vertex of each of the bent segments on the same side of each of the refrigerant pipelines is welded to one of the retention steel wires.

11. The semiconductor refrigerator according to claim 1, characterized in that the lower end of each of the refrigerant pipelines is located at the same horizontal level.

* * * * *